United States Patent [19]

Fukushima

[11] 4,405,245

[45] Sep. 20, 1983

[54] VARIABLE SPEED SIGNAL PRINTING APPARATUS

[75] Inventor: Takashi Fukushima, Tokyo, Japan

[73] Assignee: Ricoh Company, Ltd., Tokyo, Japan

[21] Appl. No.: 286,483

[22] Filed: Jul. 24, 1981

Related U.S. Application Data

[63] Continuation of Ser. No. 60,096, Jul. 24, 1979, abandoned.

[51] Int. Cl.[3] ..... B41J 1/08

[52] U.S. Cl. ..... 400/144.2; 400/322

[58] Field of Search ..... 400/144.22, 144.3, 320, 400/322, 328

[56] References Cited

U.S. PATENT DOCUMENTS

| | | | |
|---|---|---|---|
| 3,986,091 | 10/1976 | Quiogue et al. | 400/320 X |
| 4,101,006 | 7/1978 | Jensen et al. | 400/322 X |
| 4,103,766 | 8/1978 | Ruble et al. | 400/144.2 X |
| 4,178,108 | 12/1979 | Kane | 400/144.2 X |
| 4,180,335 | 12/1979 | Yamada | 400/322 X |
| 4,189,246 | 2/1980 | Kane et al. | 400/144.2 X |

*Primary Examiner*—Edward M. Coven
*Attorney, Agent, or Firm*—David G. Alexander

[57] ABSTRACT

A block of data corresponding to characters and spaces is stored in a buffer (32) and then recirculated through the buffer (32) twice. During the first recirculation consecutive character data and space data are counted and the counts stored in a count memory (34). During the second recirculation a maximum length of time required for type selection is computed for each set of consecutive character data and used to compute a carriage drive speed corresponding to the computed maximum length of time. The computed speeds and also computed speeds corresponding to sets of consecutive space data are stored in a speed memory (41). The data are then fed from the buffer (32) to a type selector (36) while the speeds are fed to a carriage drive (42). The carriage (13) is fed at the computed speed corresponding to the respective set of consecutive data while the respective set of consecutive data is fed to the type selector (36).

6 Claims, 7 Drawing Figures

VARIABLE SPEED SIGNAL PRINTING APPARATUS

CROSS REFERENCE TO RELATED APPLICATION

This application is a continuation of copending U.S. patent application Ser. No. 60,096, filed July 24, 1979, abandoned.

BACKGROUND OF THE INVENTION

The present invention relates to a variable speed serial printing apparatus for a computer, word processor or the like.

A typical serial printer comprises a carriage which is fed relative to a sheet of paper and carries a rotary type or printing element such as a daisy wheel, ball or cylinder. The element is rotated to a position corresponding to an input data signal and then impacted against the paper through a ribbon for printing. The carriage is moved by one space each time a character is printed or an input data signal indicates an interword space or other non-printing operation.

The carriage may be driven in a stop-start (intermittent) manner or continuously. In the intermittent mode the carriage is stopped while printing each character. In the continuous mode the carriage is moved at a constant speed which is slow enough to allow sufficient time for selection of any character. Alternatively, the carriage may be driven at an average speed determined after sensing a plurality of input data.

A variation which has been recently introduced is to drive the carriage intermittently when the computed average speed is below a predetermined value and drive the carriage at the average speed when the average speed is above the predetermined value. Although this modification allows a slight increase in printing speed, the increase is not very great. The major problem with any carriage drive system involving intermittent drive is the large motor and power consumption required to start and stop the carriage in a very short length of time. The abrupt starts and stops create excessive stress on the mechanical parts of the printer and lead to early failure, even with frequent maintenance. The size of the motor and the power consumption may be reduced substantially in systems employing only continuous drive. However, a continuous drive system enabling increased printing speed in combination with decreased motor size and power consumption has not been developed heretofore.

SUMMARY OF THE INVENTION

A serial printing apparatus embodying the present invention includes a carriage, variable speed drive means for driving the carriage, a rotary printing element mounted on the carriage and selector means mounted on the carriage for rotating the printing element to a printing position corresponding to a character data fed to the selector means, characterized by comprising computing means for discriminating a plurality of consecutive character data between non-character data and computing a maximum length of time required for the selector means to rotate the printing element from a previous printing position to a new printing position for all of the consecutive character data, and speed control means for controlling the drive means to drive the carriage at a speed corresponding to the computed maximum length of time while the consecutive character data are fed to the selector means for printing.

In accordance with the present invention, a block of data corresponding to characters and spaces is stored in a buffer and then recirculated through the buffer twice. During the first recirculation consecutive character data and space data are counted and the counts stored in a count memory. During the second recirculation a maximum length of time required for type selection is computed for each set of consecutive character data and used to compute a carriage drive speed corresponding to the computed maximum length of time. The computed speeds and also computed speeds corresponding to sets of consecutive space data are stored in a speed memory. The data are then fed from the buffer to a type selector while the speeds are fed to a carriage drive. The carriage is fed at the computed speed corresponding to the respective set of consecutive data while the respective set of consecutive data is fed to the type selector.

It is an object of the present invention to provide a variable speed serial printing apparatus which enables higher printing speed than is possible in the prior art.

It is another object of the present invention to provide a variable speed printing apparatus which comprises a motor of reduced size and power consumption compared to the prior art.

It is another object of the present invention to provide a generally improved variable speed serial printing apparatus.

Other objects, together with the foregoing, are attained in the embodiment described in the following description and illustrated in the accompanying drawing.

DESCRIPTION OF THE PREFERRED EMBODIMENT

While the variable speed serial printing apparatus of the present invention is susceptible of numerous physical embodiments, depending upon the environment and requirements of use, substantial numbers of the herein shown and described embodiment have been made, tested and used, and all have performed in an eminently satisfactory manner.

Figure 1:
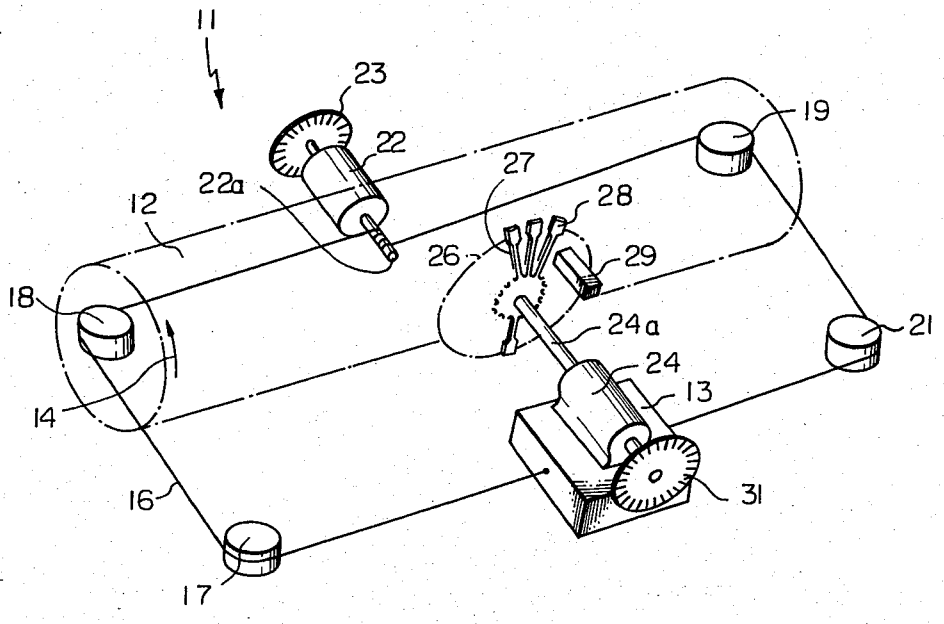
FIG. 1 is a perspective view of a variable speed serial printing apparatus embodying the present invention.

Referring now to FIG. 1 of the drawing, a serial printing apparatus embodying the present invention is generally designated by the reference numeral 11 and comprises a platen in the form of a rotary cylinder 12. A carriage 13 is mounted in front of the platen 12 for linear movement parallel to the axis of the platen 12.

Although not illustrated, a sheet of paper is wound around the platen 12. Each time a line is printed on the paper, the platen 12 is rotated in the direction of an arrow 14 by an increment equal to an interline space.

A wire 16 is connected at its ends to the carriage 13 and trained around pulleys 17, 18, 19 and 21. The wire 16 is also wound several times around a shaft 22*a* of a motor 22. The motor 22 is typically of the D.C. type and is capable of rotation in either direction. Rotation of the motor shaft 22*a* causes the wire 16 to move the carriage 13 in the desired direction parallel to the axis of the platen 12.

A disc 23 is attached to the motor shaft 22*a* for integral rotation and is formed with a pattern of circumferentially spaced slots. Although not illustrated, a photosensor comprising a light source and photoresistor or the like which are arranged on opposite sides of the disc 23 produces output signals as the photoresistor is alternately covered and uncovered by the slots. There are at least as many slots formed in the disc 23 as the number of character spaces in a line of printing.

A motor 24 is mounted on the carriage 13. A type or printing element in the form of a daisy wheel 26 is mounted on the end of a shaft 24*a* of the motor 24. The printing element 26 comprises a plurality of flexible arms 27 with character and symbol types 28 at the ends thereof, only one arm 27 and type 28 being labeled in the drawing.

The motor 24 is of the stepping type and is constructed to rotate the shaft 24*a* until a desired type 28 is in a printing position facing a hammer 29. After the selected type 28 is in the printing position the hammer 29 is driven to impact the type 28 against the paper through a ribbon (not shown) to print the desired character.

A disc 31 similar to the disc 23 is fixed to the shaft 24*a* and associated with a photosensor (not shown). The photosensor provides output signals as the disc 31 is rotated which enable positioning of the wheel 26.

More specifically, the motor 22 is driven continuously to move the wheel 26 along the platen 12. When the photosensor associated with the disc 23 provides an output such as a zero crossing of a sine wave indicating a character printing position, and a character is to be printed, the hammer 29 is driven to impact the selected type 28 against the paper.

The type selection process is completed before the hammer 29 is driven. A type selector which will be described below receives a data word or byte indicating the character to be printed. The selector compares the present position of the wheel 26 with a new position of the wheel 26 at which the new selected type 28 will be in the printing position and drives the motor 24 to rotate the shaft 24*a* by a number of steps corresponding to the difference in position. The photosensor associated with the disc 31 produces one or more signals for each step of rotation of the shaft 24*a*. The output signals are counted and the shaft rotation stopped when the number of signals counted indicates that the required number of motor shaft steps have been traversed. The types 28 are arranged on the wheel 26 so that the most frequently used types 28 are close together. The object of this is to minimize the length of time required for type selection. In addition, the shaft 24*a* is rotated in a direction so as to minimize the distance which the wheel 26 must be rotated for type selection. The maximum length of time required for type selection occurs when the new selected type is located 180° from the previous type.

Figure 2:
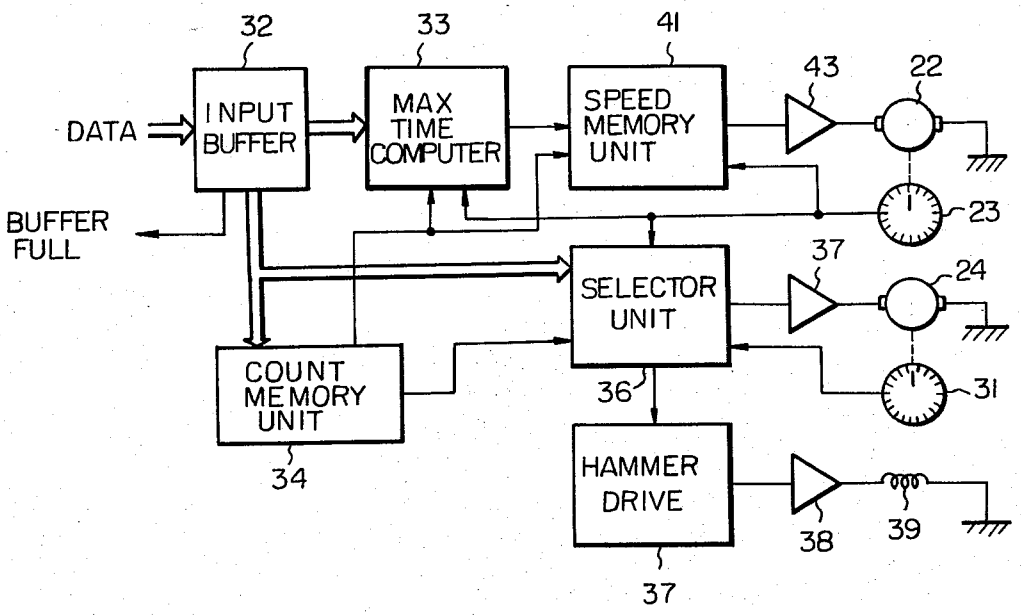
FIG. 2 is a block diagram of the apparatus.

Referring now to FIG. 2, input data in the form of bytes or words is applied to an input buffer 32 in serial or parallel format. Each data corresponds to a character or symbol to be printed or a non-printing operation such as space, backspace, tab, line feed, carriage return or the like. The output of the buffer 32 is connected to a maximum time computer 33, a count memory unit 34 and a selector unit 36. Output of the unit 34 are connected to the computer 33 and selector unit 36. The output of the selector unit 37 is connected through a drive amplifier 37 to the motor 24 for rotation of the wheel 26 to the printing position corresponding to the input data. The output of the photosensor associated with the disc 31 is connected to an input of the selector unit 36. The operation of the selector unit 36, motor 24 and disc 31 were described above.

Another output of the selector unit 36 is connected to a hammer drive 37. The selector 36 feeds a signal to the hammer drive 37 when the carriage 13 is in a character printing position and a character is to be printed. The hammer drive 37 feeds a drive signal to a drive amplifier 38 which energizes a solenoid 39. The solenoid 39 drives the hammer 29 to print the character.

The output of the computer 33 is connected to a speed memory unit 41. The output of the unit 41 is a signal corresponding to the speed at which the carriage 13 should be driven and is a function of the input data. The signal from the unit 41 is fed through a drive amplifier 42 to the motor 22. The photosensor associated with the disc 23 feeds signals to the computer 33, speed memory unit 41 and selector unit 36.

Figure 3:
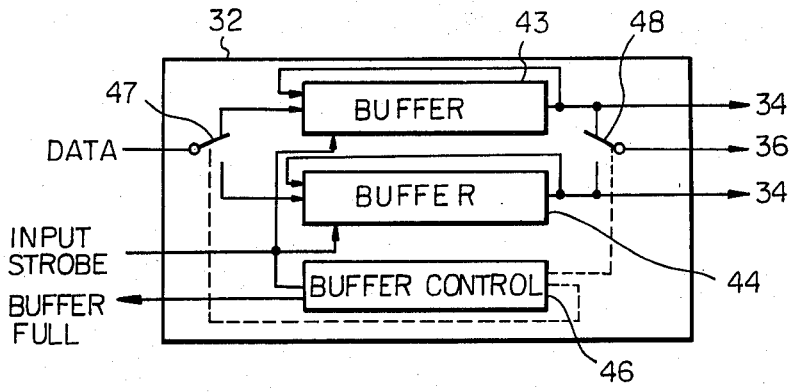
FIG. 3 is a block diagram of input buffer of the apparatus.
Figure 4:
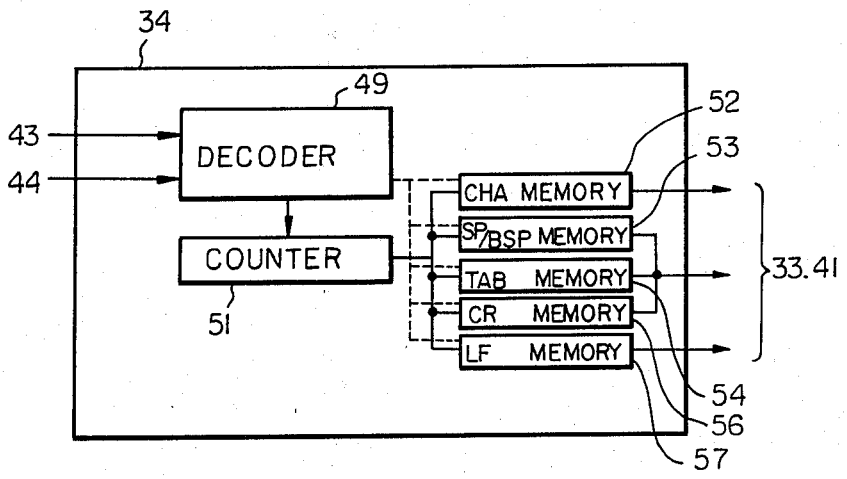
FIG. 4 is a block diagram of a count memory unit of the apparatus.

The input buffer 32 is shown in FIG. 3 as a comprising first and second buffers 43 and 44 in the form of shift registers or read-write memories. Each memory 43 and 44 is constructed so that data may be recirculated therethrough while the data is output. Each memory 43 and 44 is capable of storing a block of data such as sixteen data or bytes. A buffer control 46 operates an input switch 47 to feed data into either the memory 43 or the memory 44 and also an output switch 48 for feeding the data from either the memory 43 or 44 to the selector unit 36 for printing. The outputs of the buffers 43 and 44 are connected directly to a decoder 49 of the count memory unit 34 which is shown in FIG. 4. Input strobes are applied to the buffers 43 and 44 as well as to the buffer control 46. Although not shown, means are provided for also applying high frequency clock pulses to the buffers 43 and 44 and control 46.

The output of the decoder 49 is connected to a counter 51. Enable signals are also fed from the decoder 49 to a character memory 52, space-backspace memory 53, tabulation memory 54, carriage return memory 56 and line feed memory 57. The outputs of the memories 52, 53, 54, 56 and 57 are connected to the time computer 33.

Figure 5:
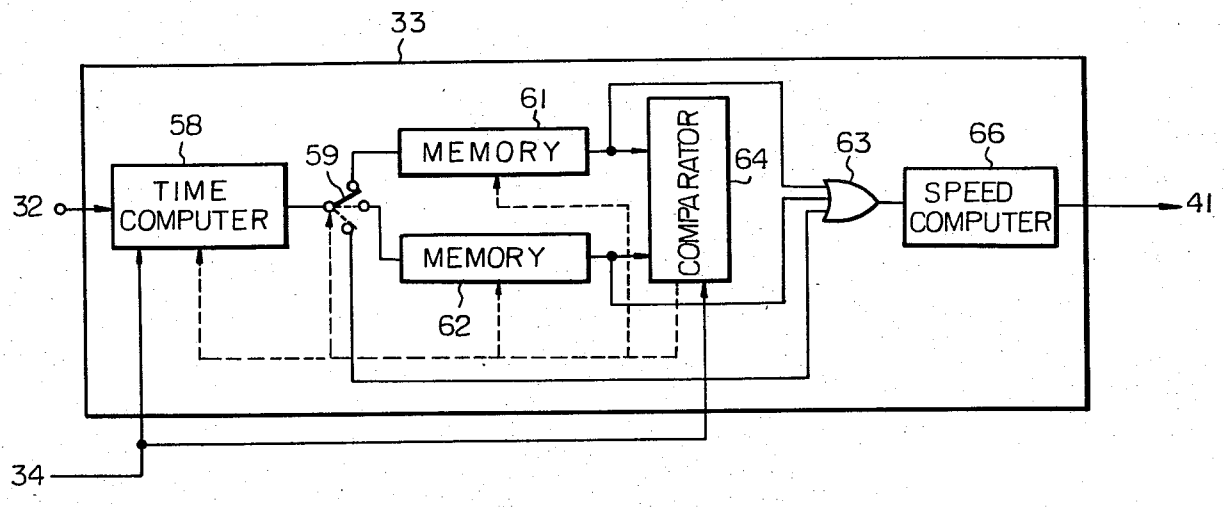
FIG. 5 is a block diagram of a speed computing unit of the apparatus.

The computer 33 is shown in FIG. 5 and comprises a time computer 58. The output of the time computer 58 is selectively connected through a switch 59 to a memory 61, a memory 62 or an OR gate 63. The outputs of the memories 61 and 62 are connected to a comparator 64 which controls the switch 59 and also the memories 61 and 62. The outputs of the memories 52, 53, 54, 56 and 57 of the count memory unit 34 are connected to inputs of the time computer 58 and comparator 64 and also to a speed computer 66. The output of the OR gate 63 is connected to an input of the speed computer 66.

The buffers 43 and 44 are operated alternately. While a block of sixteen data or bytes is being stored in one of the buffers 43 or 44, the data in the other buffer 43 or 44 is being fed out for printing. Each data or byte comprises, typically, a seven bit ASCII code plus a parity bit.

Where each block of data consists of sixteen bytes, the buffer control 46 comprises a counter which is adapted to count up to sixteen and overflow, producing a carry signal. The data are sequentially stored in the buffer 43 or 44 in synchronism with input strobe pulses. The counter in the buffer control 46 counts the input strobe pulses. When sixteen input strobe pulses have been counted, it indicates that sixteen data have been stored in the buffer 43 or 44. The carry signal causes the switches 47 and 48 to be changed over. The buffer control 46 produces a buffer full signal to prevent further data input when both buffers 43 and 44 are full or when one buffer is full and the other buffer is being operated in the output mode. The buffer control 46 changes over the switches 47 and 48 so that the data is fed to one buffer 43 or 44 and fed out of the other buffer 43 or 44 to the selector unit 36.

After the data have been stored in one of the buffers 43 or 44 and prior to feeding the data out to the selector unit 36 for printing, two preprocessing operations are performed. The preprocessing operations are performed at very high speed in a length of time which is negligible compared to the printing operation by feeding high frequency clock pulses to the buffers 43 and 44 and control 46. Thus, the operation of the printing apparatus 11 is not slowed down by the preprocessing operations.

During the first preprocessing operation the data are recirculated through the buffer 43 or 44 which is to be used in the output mode for printing characters corresponding to the data. At the same time, the data are fed out of the buffer 43 or 44 to the decoder 49 of the count memory unit 34.

The decoder 49 decodes the data to determine whether it is character data CHA, space data SP, backspace data BSP, tabulation data TAB, carriage return data CR or line feed data LF. The counter 51 is initially reset to zero. Assuming that the first data is a character, the counter 51 will be incremented to the count of one in response to the character. Assuming that the next data is also a character, the counter 51 will be incremented to the count of two. If the next data is not a character, for example a space code, the count in the counter 51, in this example two, will be stored in the first location in the character memory 52 and the counter 51 reset to zero. In other words, the first count stored in the memory 52 is the number of the first set of consecutive character data. Since two character data were sensed by the decoder 49, the first count stored in the memory 52 is two.

If the data following the character data consists of three space codes, the counter 51 will be progressively incremented to three and the count of three stored in the first location in the memory 53 after the next different data, for example a line feed code, is sensed by the decoder 49. At this time the counter 51 will be reset.

Figure 6:
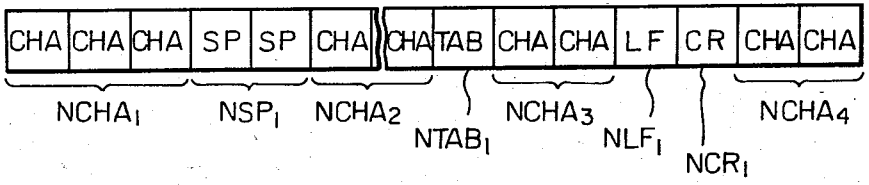
FIG. 6 is a diagram illustrating data.

FIG. 6 illustrates a typical exemplary block of data. The first set of consecutive data of the same type consists of three characters and is designated as NCHA1. This is followed by two space codes NSP1, four character codes NCHA2, one tab code NTAB1, two character codes NCHA3, one line feed code NLF1, one carriage return code NCR1 and two character codes NCHA4. After the first preprocessing of this block of data, four counts, NCHA1=3, NCHA2=4, NCHA3=2 and NCHA4=2 will be stored in successive locations in the character memory 52. One count, NSP1=2 will be stored in the space-backspace memory 53. One count, NTAB1=1, will be stored in the tabulation memory 54. One count, NLF=1 will be stored in the line feed memory 57. One count, NCR1=1 will be stored in the carriage return memory 56.

During the second preprocessing operation, the data are again recirculated at high speed through the buffer 43 or 44 and fed to the maximum time computer 33 and count memory unit 34. The decoder 49 decodes the data to determine the type. If the data is a character, the decoder 49 controls the character memoty 49 to feed the first count, for example NCHA1=3, to the time computer 58, comparator 64 and speed computer 66.

The time computer 58 computes the new position of the wheel 26 corresponding to the first character data, compares the new position with the present position of the wheel 26 and computes, as a predetermined function of the difference in position, the length of time required to rotate the wheel 26 from the present position to the new position. After producing an output corresponding to the computed length of time, the time computer 58 sets the present position equal to the new position in preparing to calculate the length of time required to rotate the wheel 26 to the position of the second character.

The output of the time computer 58 is set into the memory 61. Since the output of the memory 52 is being fed to the time computer 58 and comparator 64, these units are able to know that the data being processed is a character code or data. The comparator 64 compares the outputs of the memories 61 and 62 to determine whether the length of time stored in the memory 61 is larger than the length of time stored in the memory 62 or vice-versa. Since the memory 62 was initially reset prior to the second preprocessing operation, the length of time stored in the memory 62 is zero. Since the length of time stored in the memory 61 is larger than the length of time stored in the memory 62, the comparator 64 feeds a reset or clear signal to the memory 62 and changes over the switch 59 to connect the output of the time computer 58 to the input of the memory 62.

The time computer 58 computes the length of time required for rotation of the wheel 26 to the position of the second character and stores this length of time in the memory 62. The comparator 64 compares the lengths of time stored in the memories 61 and 62. If the length of time stored in the memory 62 is larger or longer than the length of time stored in the memory 61, the comparator 64 will reset the memory 61 to zero and change over the switch 59 to connect the output of the time computer 58 to the input of the memory 61. If, conversely, the length of time stored in the memory 62 is smaller or shorter than the length of time stored in the memory 61, the comparator 64 will clear or reset the memory 62 and change over the switch 59 to connect the output of the time computer 58 to the memory 62. This is continued for a number of times equal to the count fed to the time computer 33 from the memory unit 34, in this case NCHA1=3.

The effect of this operation is to compare the lengths of time required for rotation of the wheel 26 to the printing position for the first set of three consecutive character data. The present length of time is compared with the previously maximum length of time. If the present length of time is longer than the previous maximum length of time, it is retained as the new maximum length of time. If the present length of time is shorter than the previous maximum length of time, it is discarded and the previous maximum length of time retained. Thus, at the end of the operation the maximum length of time for the three characters is stored in the memory 61 or 62 and fed to the speed computer 66 through the OR gate 64.

The speed computer 66 computes a drive speed of the carriage 13 as a predetermined function of the computed maximum length of time. The longer the length of time required for character selecting rotation of the wheel 26, the slower the carriage 13 may be driven. If the carriage 13 is driven too fast, the carriage 13 will pass the proper position for printing the character on the paper before the wheel 26 is rotated sufficiently to being the selected type 28 to the printing position.

The output of the speed computer 66, indicating the maximum allowable carriage drive speed for the set of consecutive character data is fed to the speed memory unit 41 along with the count from the counter 52 of the count memory unit 34 and stored in a first memory location therein as a first computed drive speed. The count from the counter 52 is also stored since it indicates the number of character spaces along the platen 12 for which the speed is to be maintained.

Then, the next set of consecutive data, in this case the two space codes, are operated on by the time computer 58. However, since although the carriage 13 is moved by two spaces in response to the two space data codes, no rotation of the wheel 26 is required. In this case, the time computer 58 feeds a small maximum length of time signal to the speed computer 66 through the switch 59 and OR gate 63. In response, the speed computer 66 produces a second computed speed which is relatively high and stores this speed in the second memory location in the speed memory unit 41 along with the count NSP1=2. This indicates that the carriage 13 is to be driven at high speed for two spaces. The operation for line feed, carriage return and other non-printing operations is similar to the operation for the space codes.

Figure 7:
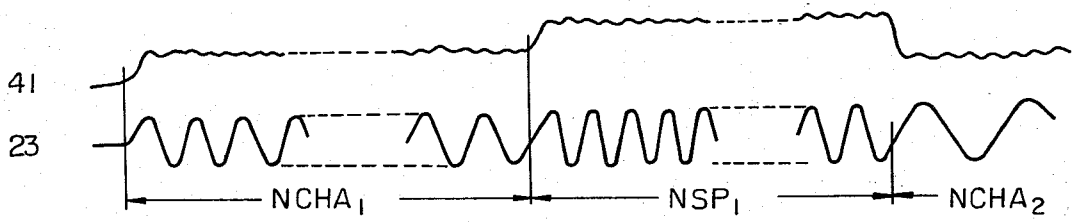
FIG. 7 is a graph illustrating a carriage drive speed in the apparatus.

After the second preprocessing operation is completed, the computed speeds and respective counts from the counters 52, 53, 54, 56 and 57 are stored in the speed memory unit 41. Then, the data is fed from the buffer 43 or 44 to the selector unit 36 at a sufficiently low speed to enable printing. At the same time, the speed signals are fed from the speed memory unit 41 to the drive amplifier 42 and thereby to the motor 22 for driving the carriage 13. As shown in FIG. 7, the output of the speed memory unit 41 is synchronized with the data output of the buffer 43 or 44 so that the first speed signal is applied to the motor 22 while the three character data of the first consecutive set are applied to the selector unit 36. Then, the second speed signal is fed from the speed memory unit 41 to the motor 22 while the carriage 13 is moved by two spaces so that the carriage 13 is driven at high speed during the spacing operation. Since no rotation of the wheel 26 is required during spacing, the carriage 13 may be driven at a higher speed during spacing than during character printing. Then, the third speed signal corresponding to the second set of consecutive character data is applied to the motor 22 while the character data are applied to the selector unit 36.

In summary, it will be seen that the present invention provides a variable speed serial printing apparatus which not only operates as much as 30% faster than prior art printing apparatus but also comprises a small drive motor 22 for the carriage 13 which consumes a comparatively small amount of electrical power. Various modifications will become possible for those skilled in the art after receiving the teachings of the present disclosure without departing from the scope thereof. For example, the apparatus 11 may be adapted to compute a speed signal correspoding to the maximum type selection time for an entire block of data in the buffer 43 or 44 rather than a set of consecutive characters, spaces etc. in the block and produce a speed signal corresponding thereto.

What is claimed is:

1. A serial printing apparatus constructed to receive serial data including character data and non-character data, the apparatus including a carriage, variable speed drive means for driving the carriage, a rotary printing element mounted on the carriage and selector means mounted on the carriage for rotating the printing element to a printing position which is a predetermined function of a character data fed to the selector means, characterized by comprising;

computing means for discriminating all consecutive character data between two non-character data and computing a length of time required for the selector means to rotate the printing element from a previous printing position to a new printing position for each of the consecutive character data and storing a computed maximum length of time; and speed control means responsive to the computing means for controlling the drive means to drive the carriage at a speed corresponding to the computed maximum length of time while the consecutive character data are fed to the selector means for printing.

2. A serial printing apparatus constructed to receive serial data including character data and non-character data, the apparatus including a carriage, variable speed drive means for driving the carriage, a rotary printing element mounted on the carriage and selector means mounted on the carriage for rotating the printing element to a printing position which is a predetermined function of a character data fed to the selector means, characterized by comprising;

computing means for discriminating all consecutive character data between two non-character data and computing a length of time required for the selector means to rotate the printing element from a previous printing position to a new printing position for each of the consecutive character data and storing a computed maximum length of time;

speed control means responsive to the computing means for controlling the drive means to drive the carriage at a speed corresponding to the computed maximum length of time while the consecutive character data are fed to the selector means for printing; and an input buffer and buffer control means for causing the consecutive character data to be recirculated at high speed through the input buffer while feeding the consecutive character data to the computing means for computing the maximum length of time and subsequently feeding the consecutive character data at low speed to the selector means for printing.

3. An apparatus as in claim 2, in which the input buffer is constructed to store a block of data comprising character data and space data, the computing means being further constructed to count consecutive space data, the speed control means controlling the drive means to drive the carriage at a high speed corresponding to the count of consecutive space data while the consecutive space data are fed to the selector means for printing.

4. An apparatus as in claim 3, further comprising count memory means for storing counts of consecutive character data and space data, the computing means computing speeds as predetermined functions of the counts of consecutive character data and space data and respective computed maximum lengths of time.

5. An apparatus as in claim 4, further comprising speed memory means for storing the computed speeds and feeding the computed speeds sequentially to the speed control means.

6. A serial printing apparatus constructed to receive serial data including character data and non-character data, the apparatus including a carriage, variable speed drive means for driving the carriage, a rotary printing element mounted on the carriage and selector means mounted on the carriage for rotating the printing element to a printing position which is a predetermined function of a character data fed to the selector means, characterized by comprising;

computing means for discriminating all consecutive character data between two non-character data and computing a length of time required for the selector means to rotate the printing element from a previous printing position to a new printing position for each of the consecutive character data and storing a computed maximum length of time;

speed control means responsive to the computing means for controlling the drive means to drive the carriage at a speed corresponding to the computed maximum length of time while the consecutive character data are fed to the selector means for printing;

an input buffer and buffer control means for causing the consecutive character data to be recirculated at high speed through the input buffer while feeding the consecutive character data to the computing means for computing the maximum length of time and subsequently feeding the consecutive character data at low speed to the selector means for printing;

the computing means being further constructed to count the consecutive character data;

count memory means for storing a count of the consecutive character data, the computing means computing the speed as a predetermined function of the count and computed maximum length of time; and speed memory means for storing the computed speed and feeding the computed speed to the speed control means.

* * * * *